US008505415B2

(12) United States Patent
Hanspers et al.

(10) Patent No.: US 8,505,415 B2
(45) Date of Patent: Aug. 13, 2013

(54) POWER WRENCH WITH SWIVELLING GEAR CASING

(75) Inventors: Jan Thomas Hanspers, Bromma (SE); Erik Mikael Monsell, Huddinge (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 831 days.

(21) Appl. No.: 12/525,774

(22) PCT Filed: Feb. 4, 2008

(86) PCT No.: PCT/SE2008/000092

§ 371 (c)(1),
(2), (4) Date: Aug. 4, 2009

(87) PCT Pub. No.: WO2008/097156

PCT Pub. Date: Aug. 14, 2008

(65) Prior Publication Data

US 2010/0107824 A1 May 6, 2010

(30) Foreign Application Priority Data

Feb. 5, 2007 (SE) ..... 0700264

(51) Int. Cl.
*B25B 17/00* (2006.01)

(52) U.S. Cl.
USPC ..... 81/57.14; 81/57; 81/57.11; 81/57.13

(58) Field of Classification Search
USPC ..... 81/57, 57.11, 57.13, 57.14
See application file for complete search history.

(56) References Cited

U.S. PATENT DOCUMENTS

| | | | | |
|---|---|---|---|---|
| 3,464,527 | A * | 9/1969 | Baker | 192/72 |
| 4,485,698 | A | 12/1984 | Adman et al. | |
| 4,625,774 | A * | 12/1986 | Stack, Jr. | 140/123 |
| 4,844,177 | A | 7/1989 | Robinson et al. | |
| 4,966,057 | A | 10/1990 | Koppatsch | |
| 5,404,775 | A | 4/1995 | Abe | |
| 5,490,439 | A * | 2/1996 | Matsumura et al. | 81/469 |
| 6,557,649 | B1 * | 5/2003 | Yang et al. | 173/171 |

OTHER PUBLICATIONS

English Language International Search Report dated Apr. 14, 2008 issued in parent Appln. No. PCT/SE2008/000092.

* cited by examiner

*Primary Examiner* — Lee D Wilson
*Assistant Examiner* — Shantese McDonald
(74) *Attorney, Agent, or Firm* — Holtz, Holtz, Goodman & Chick, P.C.

(57) ABSTRACT

A power wrench including a housing, a rotation motor, a reduction gearing connecting the motor to an output shaft, and a separate gearing casing which is rotatively and detachably mounted on the housing and supporting the output shaft. The reduction gearing is divided into a first gearing stage located in the housing and a second gearing stage located in the separate gearing casing. The first gearing stage and the second gearing stage are interconnected via an intermediate spindle, and the motor is connected to the first gearing stage via a hollow drive shaft surrounding the intermediate spindle and an angle gear. A torque sensor is associated with the first gearing stage in the form of strain gauges mounted on an elastically deformable sleeve connecting a ring gear of the first gearing stage to the housing.

6 Claims, 2 Drawing Sheets

POWER WRENCH WITH SWIVELLING GEAR CASING

This application is a U.S. National Phase Application under 35 USC 371 of International Application PCT/SE2008/000092 filed Feb. 4, 2008.

BACKGROUND OF THE INVENTION

1. Field of the Invention

The invention relates to a power wrench with a motor supported in a housing and drivingly connected to an output shaft via a reduction gearing, including a separate gearing casing swivel connected to the housing.

2. Description of Related Art

In particular the invention concerns a power wrench of the above type intended to have a torque reaction bar rigidly attached to a separate swivelling gearing casing for taking support on a stationary object in the vicinity of the screw joint being tightened, wherein the swivel connected gearing casing is intended to be rotated to obtain a proper support position for the reaction bar. A power wrench of this type is described in U.S. Pat. No. 4,485,698.

Normally, power wrenches with a reduction gearing have torque sensing means provided between a ring gear of a planetary reduction gearing and the housing to indicate the reaction torque of the gearing. However, in the above described type of power wrench having a rotatable gearing casing there is a problem and a difficulty to connect electrically a torque transducer located in the rotatable gearing casing with conductors in the tool housing. A torque transducer also tends to increase the external dimensions of the gearing casing which is disadvantageous as regards accessibility and handling of the wrench.

SUMMARY OF THE INVENTION

The main object of the invention is to provide a power wrench with a separate rotatable gear casing and having a torque transducer arrangement by which the above problem is overcome.

Further objects and advantages of the invention will appear from the following specification and claims.

A preferred embodiment of the invention is described below with reference to the accompanying drawing.

DETAILED DESCRIPTION OF A PREFERRED EMBODIMENT

Figure 1:
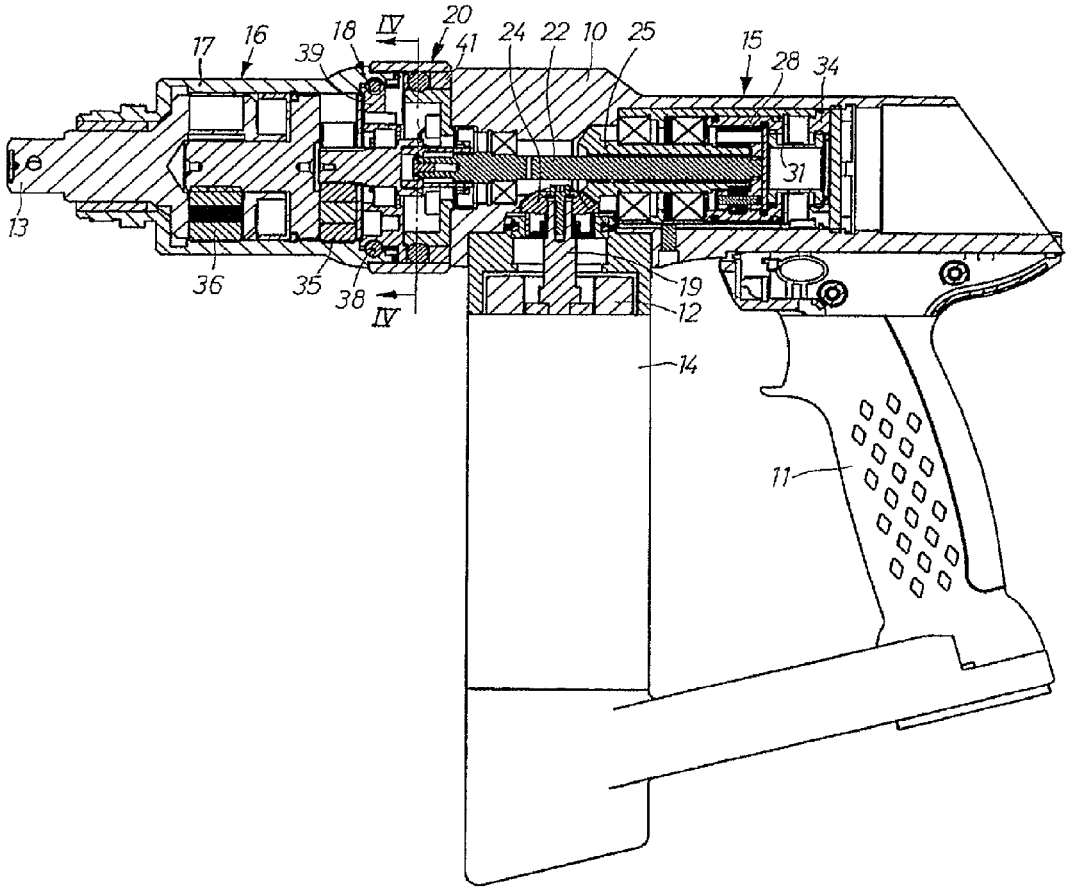
FIG. 1 shows a longitudinal section through a power wrench according to the invention.
Figure 2:
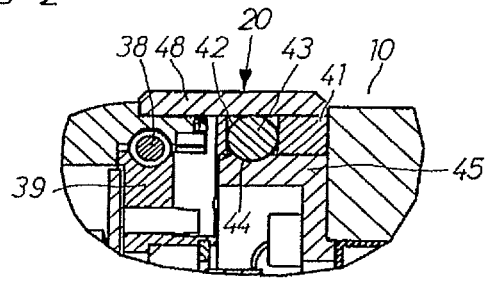
FIG. 2 shows on a larger scale a detail section through the connection device for the gearing casing relative to the tool housing.

The power wrench illustrated in the drawings is an electrically powered pistol type tool with a main tool housing 10 formed with a pistol grip 11 and an appendix casing 14 enclosing an electric motor 12. The latter is coupled to an output shaft 13 via a power transmission including a reduction gearing including two separate stages, namely a first gearing stage 15 located in the housing 10 and a second gearing stage 16 located in a separate gearing casing 17. The latter is rotatable relative to the housing 10 via a swivel connection 18, and is intended to carry a torque reaction bar for taking support against a stationary object or structure in the vicinity of the screw joint being tightened. Moreover, the gear casing 17 is connected to the housing 10 via an easily releasable quick coupling 20 which is described in further detail below.

The first gearing stage 15 is connected to the second gearing stage 16 via an intermediate spindle 22 extending in the longitudinal direction of the housing 10. The shaft 19 of the motor 12 extends perpendicularly to the longitudinal direction of the housing 10 and is drivingly connected to the first gearing stage 15 via an angle gear 24 and a tubular drive shaft 25 coaxially surrounding the intermediate spindle 22.

Figure 3:
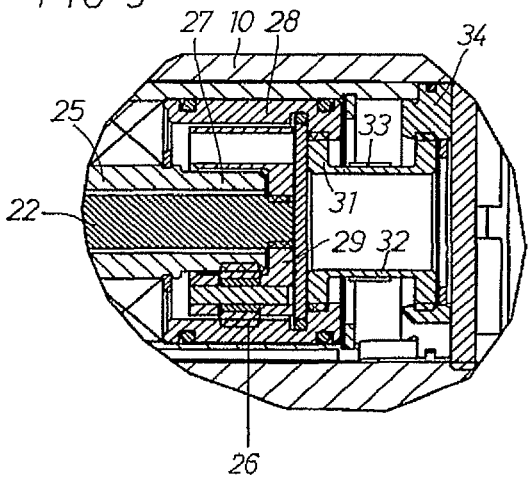
FIG. 3 shows on a larger scale a longitudinal section through the rear end of the power wrench in FIG. 1.

As illustrated in FIG. 3, the first gearing stage 15 comprises a single stage planet gearing including a sun gear 27 formed on the drive shaft 25, a ring gear 28 rotatably supported in the housing 10, planet wheels 26, and a planet wheel carrier 29 connected to the intermediate spindle 22. The ring gear 28 is retained against rotation by an axially extending tubular sleeve element 31 which at its rear end is rigidly secured to the housing 10 via a wall element 34. This sleeve element 31 has a thin walled portion 32 for providing a certain elasticity at reaction torque transfer, and strain gauges 33 are applied on the thin walled portion 32 for indicating elastic deformations of the sleeve 31 and, hence, the torsional load corresponding thereto. The strain gauges 33 are connected to a non-illustrated electronic control means, preferably provided in the tool housing 10, such that a motor power shut-off could be initiated as a predetermined torque level is reached.

The second gearing stage 16 comprises two consecutive planetary gearings 35, 36 of a conventional type having their ring gears formed on the inner wall of the gear casing 17 such that the reaction torque is transferred to the casing 17 and further via a reaction bar to a stationary support structure in the vicinity of the screw joint being tightened.

Figure 4:
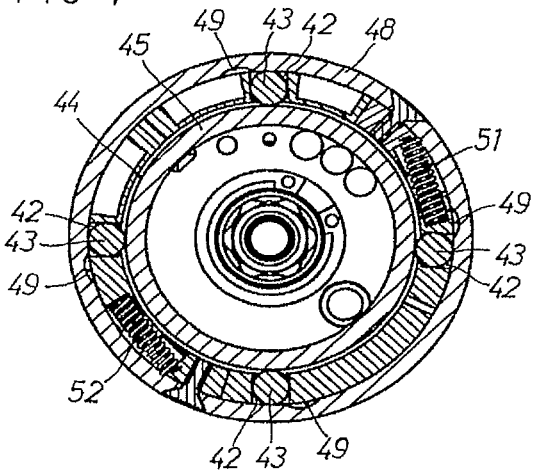
FIG. 4 shows a cross section along line IV-IV in FIG. 1.

The gear casing 17 is connected to the housing 10 via the quick coupling 20 and the swivel connection 18 which comprises a number of balls 38 partly received in circumferential grooves in the casing 17 and a rotatable annular element 39 in the casing 17. Accordingly, the annular element 39 is rotatable but axially locked to the casing 17 via the balls 38. The annular element 39 has a rearwardly extending flange 41 which is provided with a number of through apertures 42 in which a number of lock balls 43 are received. These balls 43 form together with the apertures 42, a circumferential groove 44 in a wall element 45 in the housing 10 and a lock ring 48 the quick coupling 20. The lock ring 48 is carried on the casing 17 and is manually rotatable between a lock position where the balls 43 are maintained in their engagement with the groove 44 and a release position in which the balls 43 are received in pockets 49 in the lock ring 48, thereby leaving their engagement with the groove 44. As illustrated in FIG. 4 the lock ring 48 is biased towards its locking position by means of two springs 51, 52.

The second gearing stage 16 forms a gearing unit which is one of a number of interchangeable gearing units all having different reduction ratios but identical quick coupling means. The gearing units are attachable one at a time to the power wrench housing 10, which means that the operator can choose reduction ratio in dependence of the actual application of the power wrench. The quick coupling 20 arrangement makes it easy to change gearing unit and reduction ration, which means that you can use the same power wrench for a number of operations with different demands for output torque, speed etc.

In operation the power wrench is connected to an electric power source via a non-illustrated cable, and a suitable reaction bar is attached to the front end of the gearing casing 17. A nut socket is attached to the output shaft 13 and applied on a screw joint to be tightened. As the motor starts operating the power of the motor shaft 19 is transferred to the drive shaft 25 via the angle gear 24, and the sun gear 27 formed on the drive shaft 25 and forming part of the first gearing stage 15 delivers power to the intermediate spindle 22 via the planet wheels 26 and the planet wheel carrier 29. The power is further transferred to the output shaft 13 via the planetary gearings 35 and 36 of the second gearing stage 16. The reaction torque exerted on the ring gear 28 of the first gearing stage 15 is transferred to the housing 10 via the sleeve element 31 and the wall element 34. The thin walled portion 32 of the sleeve element 31 will be slightly elastically deformed by the reaction torque load transferred, and the strain gauge means 33 attached to the thin wall portion 32 will indicate a reaction torque load that is proportional to the output torque delivered by the output shaft 13. As the delivered torque output reaches a predetermined level, as indicated by the strain gauge means 33, the control unit will initiate a power shut-off and terminate the tightening process.

By splitting the reduction gearing into two stages, whereof one is contained in a swivelled casing attached to the front end of the tool housing and another is disposed in the housing, it is possible to keep down the size and weight of the gearing casing and thereby obtain a better balance and accessibility of the tool. Another as important advantage by the arrangement according to the invention is to separate the torque transducer from the swivelled gearing casing thereby avoiding sensitive electric connections between a swivelling part and the housing. The torque transducer is also well protected inside the housing both at use of the tool and during assembly operations.

The invention claimed is:

1. A power tool, comprising:

a housing;

a rotation motor;

a reduction gearing;

an output shaft; and a separate gearing casing carried on the housing and supporting the output shaft;

wherein:

said reduction gearing comprises a first gearing stage disposed in the housing, a second gearing stage disposed in the gearing casing, and a torque sensing device associated with said first gearing stage and arranged to indicate a torque corresponding to a torque delivered via the output shaft;

the gearing casing together with said second gearing stage form a separate gearing unit which is detachably connected to the housing;

said first gearing stage is connected to said second gearing stage via an intermediate spindle;

said motor is connected to said first gearing stage via a drive shaft;

said drive shaft is tubular and surrounds co-axially said intermediate spindle, and the motor is coupled to said drive shaft via an angle gear;

said first gearing stage includes a planetary gearing with a ring gear coupled to the housing; and said torque sensing device includes a torque transferring element coupling said ring gear to the housing and arranged to be elastically deformable under a reaction torque load applied on said ring gear, and a strain gauge sensor attached to said torque transferring element and arranged to deliver electric signals in response to the reaction torque transferred to the housing via said torque transferring element.

2. A power tool according to claim 1, wherein said gearing casing is connected to the housing via a quick coupling.

3. A power tool according to claim 1, wherein the separate gearing unit comprises a plurality of separate gearing units each having different reduction ratios, the separate gearing units being interchangeable with one another so as to be detachably connected with the housing one at a time.

4. A power tool, comprising:

a housing;

a rotation motor;

a reduction gearing;

an output shaft; and a separate gearing casing carried on the housing and supporting the output shaft;

wherein:

said reduction gearing comprises a first gearing stage disposed in the housing, a second gearing stage disposed in the gearing casing, and a torque sensing device associated with said first gearing stage and arranged to indicate a torque corresponding to a torque delivered via the output shaft;

the gearing casing together with said second gearing stage form a separate gearing unit which is detachably connected to the housing;

said first gearing stage includes a planetary gearing with a ring gear coupled to the housing; and said torque sensing device includes a torque transferring element coupling said ring gear to the housing and arranged to be elastically deformable under a reaction torque load applied on said ring gear, and a strain gauge sensor attached to said torque transferring element and arranged to deliver electric signals in response to the reaction torque transferred to the housing via said torque transferring element.

5. A power tool according to claim 4, wherein said gearing casing is connected to the housing via a quick coupling.

6. A power tool according to claim 4, wherein the separate gearing unit comprises a plurality of separate gearing units each having different reduction ratios, the separate gearing units being interchangeable with one another so as to be detachably connected with the housing one at a time.

* * * * *